US009316451B2

(12) United States Patent
Christenson

(10) Patent No.: US 9,316,451 B2
(45) Date of Patent: Apr. 19, 2016

(54) BUFFER LOCKING SYSTEM

(71) Applicant: Marc Christenson, Glenview, IL (US)

(72) Inventor: Marc Christenson, Glenview, IL (US)

( * ) Notice: Subject to any disclaimer, the term of this patent is extended or adjusted under 35 U.S.C. 154(b) by 0 days.

(21) Appl. No.: 13/743,309

(22) Filed: Jan. 16, 2013

(65) Prior Publication Data

US 2013/0192114 A1 Aug. 1, 2013

Related U.S. Application Data

(60) Provisional application No. 61/587,114, filed on Jan. 16, 2012.

(51) Int. Cl.
*F41A 3/84* (2006.01)
*F41A 3/12* (2006.01)

(52) U.S. Cl.
CPC .... *F41A 3/12* (2013.01); *F41A 3/84* (2013.01)

(58) Field of Classification Search
CPC ..... F41A 3/66; F41A 3/26; F41A 3/18; F41A 5/18; F41A 3/28; F41A 3/84; F41C 23/16
USPC ..... 42/16, 69.02, 74, 75.04; 89/44.01, 89/44.02, 198, 189, 191.01
See application file for complete search history.

(56) References Cited

U.S. PATENT DOCUMENTS

| | | | | |
|---|---|---|---|---|
| 3,688,641 | A * | 9/1972 | Curtis et al. | 89/189 |
| 3,977,296 | A * | 8/1976 | Silsby et al. | 89/198 |
| 2011/0094373 | A1* | 4/2011 | Cassels | 89/191.01 |

* cited by examiner

*Primary Examiner* — Samir Abdosh
*Assistant Examiner* — John D Cooper
(74) *Attorney, Agent, or Firm* — James M. Faier; Martin Faiger; Faier & Faier P.L.

(57) ABSTRACT

A buffer locking assembly comprised of a carrier insert and buffer assembly where the carrier insert is nested in the rearward end of a bolt carrier of a bolt carrier assembly of a rifle weapon, such as an AR15/M4 rifle, wherein a novel carrier insert and buffer assembly interact during firing to align the buffer recoil spring, buffer assembly, carrier insert, and bolt carrier assembly when the bolt carrier assembly is reciprocated as the rifle is fired. The invention also includes a method for maintaining longitudinal alignment of the buffer assembly with the bolt carrier assembly.

14 Claims, 6 Drawing Sheets

BUFFER LOCKING SYSTEM

PRIORITY CLAIM

This application claims priority from applicant's provisional application filed 16 Jan. 2012, identified as Application No. 61/587,114, for a BUFFER LOCKING SYSTEM.

FIELD OF THE INVENTION

This disclosure is drawn to a buffer locking system which improves the functioning, assembly, and disassembly of rifle types such as a AR15 or M4. For optimal improved reliability and functioning, the AR15/M4 type firearms benefit from precision alignment of its bolt carrier assembly. This buffer locking assembly device assures alignment of the bolt carrier assembly. The improvement is achieved by addition of a carrier insert into the bolt carrier assembly and replacement of the conventional buffer assembly with an improved novel buffer assembly by having alignment means such as a spring loaded ball bearing device with an alignment concavity in the striking surface on the face of the buffer assembly.

The carrier insert is tubular with a collar. The tube is sized to nest within the end of the bolt carrier of the bolt carrier assembly. The collar of the carrier insert is large enough so that the carrier insert mostly will fit within the bolt carrier assembly although the collar rests on the outside edge of the rear of the bolt carrier assembly. The collar of the carrier insert is attach to a tubular housing. The carrier insert has a carrier insert cap at the end of the tube opposite the collar. The carrier insert fits within the bolt carrier assembly. The carrier insert cap and housing have aligned sockets across the diameter of one another. The carrier insert cap is held within the carrier insert housing by a removably secured pin that that passes through a first socket in the carrier insert housing then through a first socket in the carrier insert cap then through a second socket in the carrier insert cap and through a second socket in the carrier insert housing. The carrier insert housing houses a compressed spring and a ball bearing. The top of the carrier insert housing has a collar with an opening that is narrower than the diameter of the ball bearing. When the carrier insert housing with the spring and ball bearing are assembled with the ball bearing toward the collar in the housing with the spring behind the ball bearing, the ball bearing is forced against the collar so that a part of the ball bearing protrudes from the collar of the carrier insert housing.

When the AR15/M4 type weapon is fired, the following events take place:

1. The user pulls the charger handle to pull back the bolt carrier assembly into the buffer tube;
2. Pushing forward the charger handle will cause the bolt carrier assembly to load a cartridge into the chamber;
3. The bolt carrier and bolt lock into the rear of the chamber to keep the cartridge inside;
4. The user pulls the trigger causing the hammer to strike the firing pin;
5. The firing pin travels forward igniting the primer which causes the powder in the cartridge to combust and the gases from combustion to expand and the cartridge sends the bullet out of the barrel;
6. The bullet travels up the barrel past the gas block;
7. Some of the gases from firing the round re-enters the bolt carrier assembly through the gas block, gas tube and gas key;

8. The gases force the bolt carrier assembly to reciprocate forwardly and rearwardly within the receiver with the bolt moving forward and the bolt carrier assembly moving rearward;
9. The pivoting movement of the bolt ejects the casing;
10. The bolt carrier assembly moves rearwardly to reset the hammer and the bolt carrier striking the buffer assembly compresses the buffer recoil spring;
11. The buffer recoil spring sends the buffer Assembly and bolt carrier assembly forward inserting the next round into the chamber and the weapon is ready again for firing.

The buffer assembly and carrier insert effectively join the bolt carrier assembly (the bolt and bolt carrier) with the buffer assembly so that in the firing process the bolt carrier assembly remains aligned as it recipricates rearwardly and forwardly within the receiver, resulting in improved performance and reliability of the firing mechanism with desirable bolt alignment and bolt closure by removing the slack in the operation. The effective joining of the bolt carrier assembly and buffer assembly also improves fit in the receiver upper and the receiver lower. The alignment concavity in the striking surface on the face of the buffer assembly nests with the ball bearing in to carrier insert to re-align the bolt carrier assembly with each firing of the AR15/M4 where the buffer locking system is installed. The importance of the invention is magnified because AR15/M4 type weapons are made by numerous manufacturers and the parts from those manufacturers differ by some degree resulting in a more movement in the weapon. Were the tolerances tightened, the weapon might gain some accuracy but the it would likely also lose some of its reliability. The invention allows a user to use parts from different manufacturers in his or her weapon but bolt bounce in the firing action is reduced by linking up the bolt carrier assembly with the buffer assembly.

The buffer locking system is made to work with any AR15/M4 type firearm. The carrier insert fits snuggly into the bolt carrier of the bolt carrier assembly with its collar wide enough to rest on the rear edge of the bolt carrier. The buffer assembly is designed to accept the standard core in a standard buffer assembly.

The buffer locking system also helps with routine maintenance. An AR15/M15 type firearm user will commonly remove the takedown pin from the receiver lower that allows the user to pivot the receiver upper and receiver lower apart about the pivot pin. During this pivoting action, the user can catch his hand or a tool when the receiver upper and receiver lower inadvertently close. Other problems can happy when the receiver upper and receiver lower inadvertently open. By having the buffer locking system installed, the upper receiver and lower receiver stay together until and unless the user applies enough force to unmate the ball bearing on the carrier insert with the alignment concavity on the buffer assembly.

BACKGROUND OF THE INVENTION

Others have sought to address the off-alignment bolt carrier problem associated with many rifle designs. (See http://heavybuffers.com/anticant.html) The applicant inventor knows of no one, though, who provides for the self-centering alignment system of a buffer assembly and spring-loaded carrier insert that work together to align the bolt carrier assembly during the firing sequence. There is no known system that puts the elements of the buffer assembly and the bolt carrier assembly into a cooperative relationship to improve alignment while providing "slack" in the system. That "slack" is necessitated by the number of the manufacturers who produce parts for weapons like the AR15/M4 inasmuch as such manufacturers may various have parts of different sources in the same rifle. Some manufacturers have attempted to solve the carrier tilt issue by adding more material to the bolt carrier with proprietary designs. Others have attempted to address the slop of the upper and lower receivers with a plastic spacer placed between the upper and lower members but such spacers can easily become dislodged, damaged or lost.

The spring-loaded ball bearing carrier insert assembly fits known conventional equipment manufacturer carriers. The carrier insert has a corresponding buffer assembly machined with an alignment concavity or dimple which aligns the carrier. The effective joining of the buffer assembly and the bolt carrier assembly allows for the receiver lower and receiver upper to be fit tighter and the bolt to stay aligned much better. The buffer locking system allows the bolt carrier constantly to be under forward pressure to assure the bolt is in the closed position and will therefore fire safely and more reliably over the life of the rifle.

In testing, applicant has found the buffer locking system invention embodying the present invention to keep the bolt carrier assembly aligned for better reliability and even wear on the bolt head, extractor and barrel extension, and for less part fatigue and wear. Also the structure disclosed in the present application keeps constant light pressure on the bolt carrier assembly ensuring better bolt lock for enhanced reliability especially even under fouled and dirty rifle conditions. Moreover, the system reduces "bolt carrier tilt" seen in many piston designs, allowing for less wear on the buffer tube and less friction that could cause reliability issues. The system lowers the chance of "bolt bounce" because of the constant forward pressure on the bolt carrier assembly thereby providing enhanced reliability. The system enhances bolt carrier assembly alignment, thereby providing a better ejection pattern. The system improves the fit of the receiver upper and receiver lower. The present system is composed of drop-in parts where, even if the carrier insert were lost, the rifle would still function.

OBJECTS OF THE INVENTION

The following are objectives of the carrier insert-buffer assembly invention:

1. To provide a system to improve alignment of the bolt carrier assembly;
2. To provide a system to improve reliability and improve even wear on the bolt head, extractor and barrel extension;
3. To provide a system to keep constant pressure on the bolt carrier assembly to ensure better bolt locking for enhanced reliability, especially even under fouled and dirty rifle conditions;
4. To provide a system to reduce bolt carrier assembly tilt seen in many piston designs, thereby allowing for less wear and friction on the buffer tube that would undermine rifle reliability;
5. To provide a system to reduce the likelihood of bolt bounce because of the constant forward pressure on the bolt carrier assembly;
6. To provide a system to enhance ejection pattern;
7. To provide a system to improve the fit of the receiver upper and receiver lower; and,
8. To provide a system where the rifle would still function if the carrier insert were missing from the rifle.

SUMMARY OF THE INVENTION

The invention consists of a carrier insert that fits in the open end of the bolt carrier (the end opposite the bolt) and a buffer assembly and to provide a method for aligning a carrier insert assembling in the buffer assembly of a bolt carrier that replaces the traditional buffer assembly of a rifle weapon, particularly the AR15/M4 rifle. The carrier insert has a spring-loaded ball bearing in a collar of the insert housing that, when seated in the bolt carrier, allows the collar to rest on the end of the bolt carrier assembly so that the ball bearing protrudes from the approximate center of the end of the bolt carrier assembly. During firing, the bolt carrier assembly reciprocates rearwardly then forwardly within the receiver and buffer tube. The buffer assembly ball bearing aligning device abuts the spring in the buffer tube. The forward end of the buffer assembly aligning device is approximately the diameter of the buffer tube so that the buffer assembly can move easily rearward and forward within the buffer tube.

The frontward edge of the buffer assembly has a striking face with an alignment concavity at its approximate center. When the carrier insert moves rearward with the bolt carrier assembly, when the weapon is fired, the ball bearing and collar strike the striking face and alignment concavity thereby forcing the alignment of the bolt carrier assembly as it moves within the rifle receiver. The carrier insert and the buffer assembly being separate pieces, and the carrier insert having some movability designed into it because of the spring-loaded ball bearing, the upper and lower receiver may be easily taken apart for review and maintenance without the receiver flopping open, thereby avoiding the high potential of marring the finish on the rifle. The forward pressure exerted by the carrier insert ensures closing of the bolt even under fouled and dirty conditions. The design movability of the carrier insert and buffer assembly also allow that the device can be used with similar weapons and parts made by a various manufacturers.

DETAILED DESCRIPTION OF THE INVENTION

Figure 1:
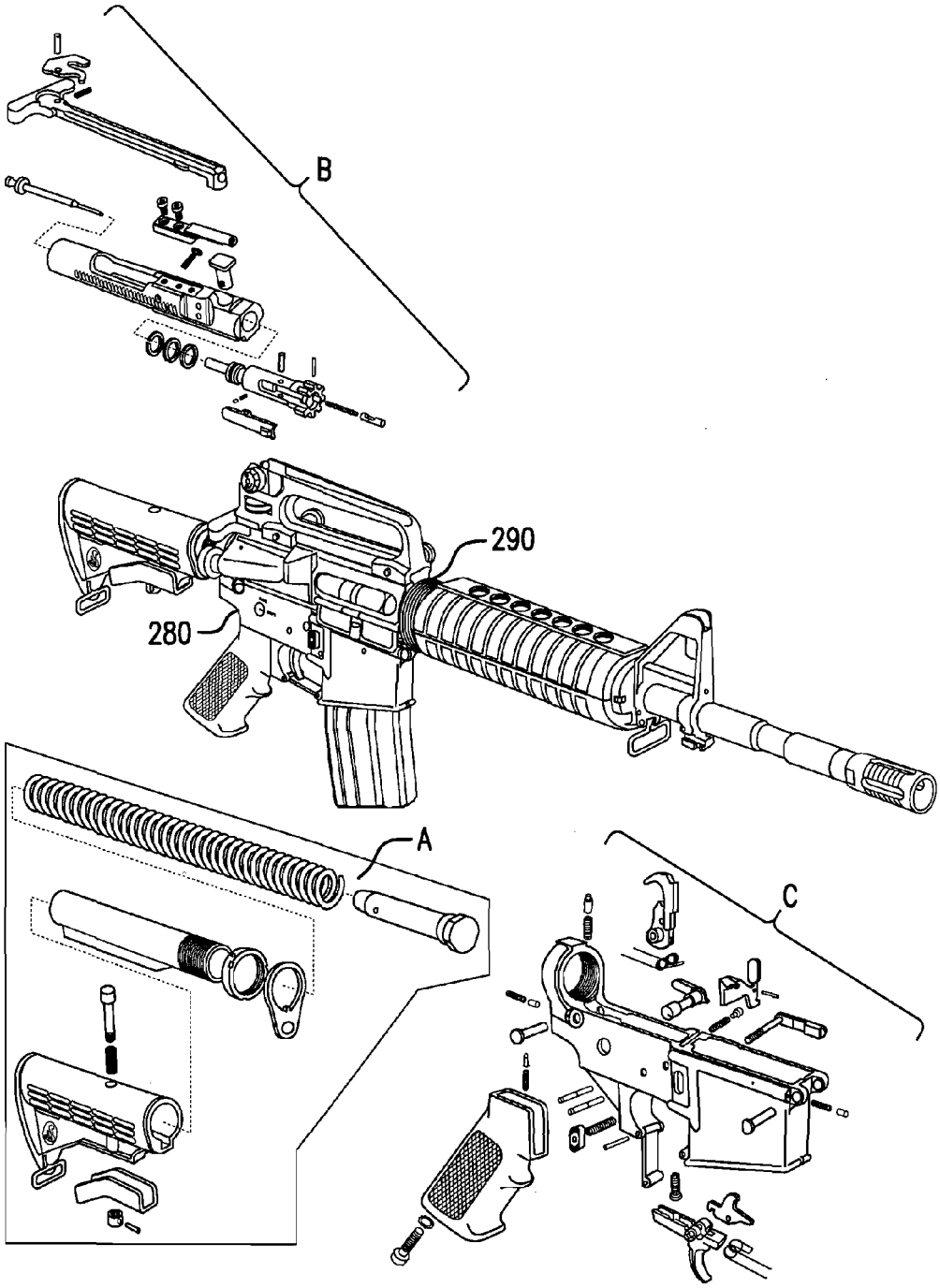
FIG. 1 PRIOR ART
FIG. 1 is a exploded view of a conventional prior art weapon, showing a prior art bolt carrier assembly and buffer assembly for an AR15/M4 type firearm, marked "Prior Art"

A conventional rifle weapon, such as a AR15/M6. is shown in FIG. 1, and includes views of a conventional buffer assembly A, bolt carrier assembly B, and receiver lower assembly C.

Figure 3:
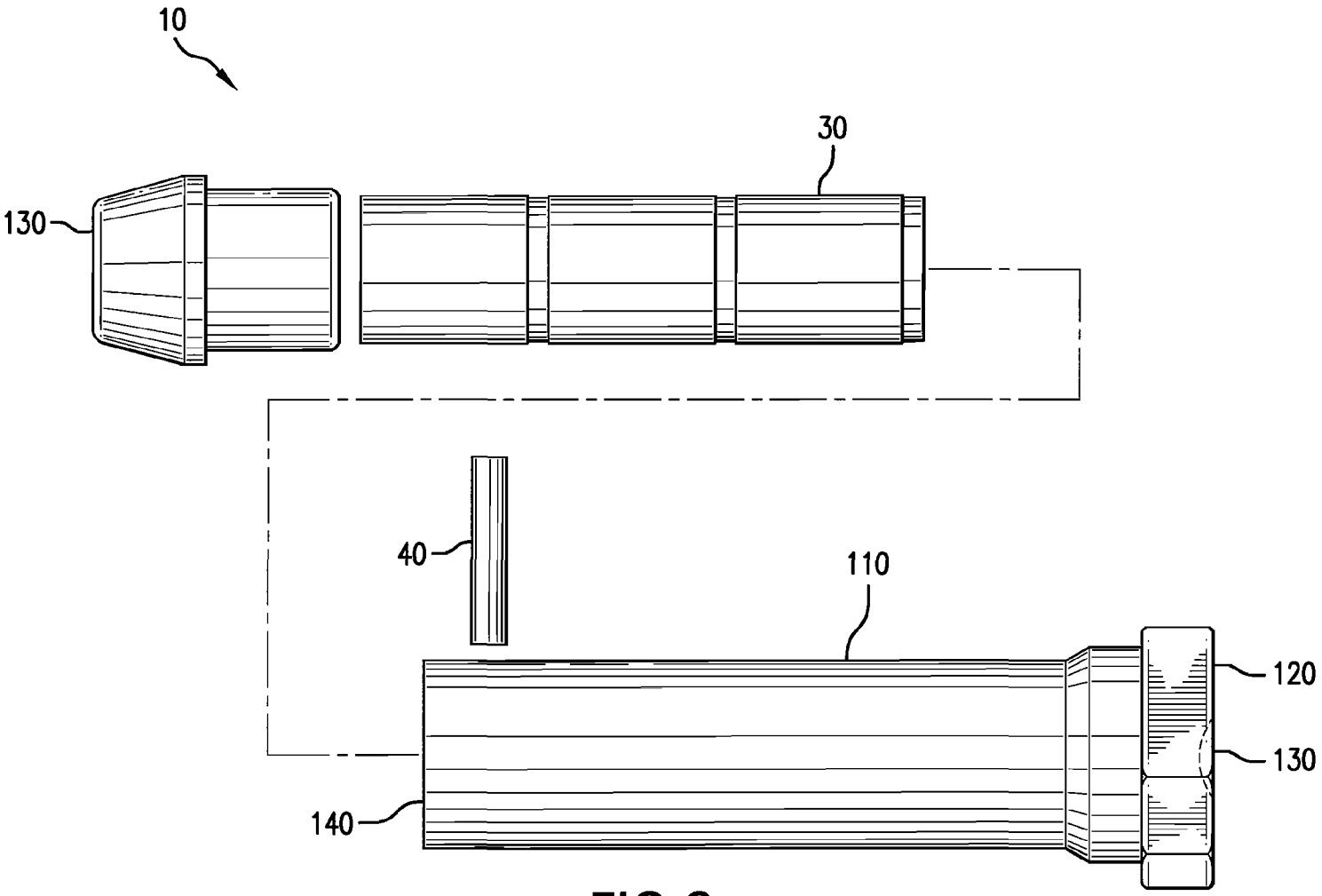
FIG. 3 is a schematic break-apart view of the buffer assembly for an firearm useful in the present invention.

As shown in FIG. 1, a conventional buffer assembly A has a tube which receives a spring and a buffer plug-like assembly. In the present invention (see FIG. 3), the buffer assembly 10 preferably is comprised of a buffer assembly sheath 110 telescoped over a core 30, The sheath 110 has a striking surface 120 at a closed end, with an alignment concavity 130, and an opening 140 at its other end to receive the core 30. The core has a terminus 150 at its remote end and a shoulder which acts as a stop for the core when the core and sheath are interfit together. The core 30 and sheath 110 are secured together by a pin 40 which penetrates the walls of the core and sheath having a terminus 150.

Figure 2:
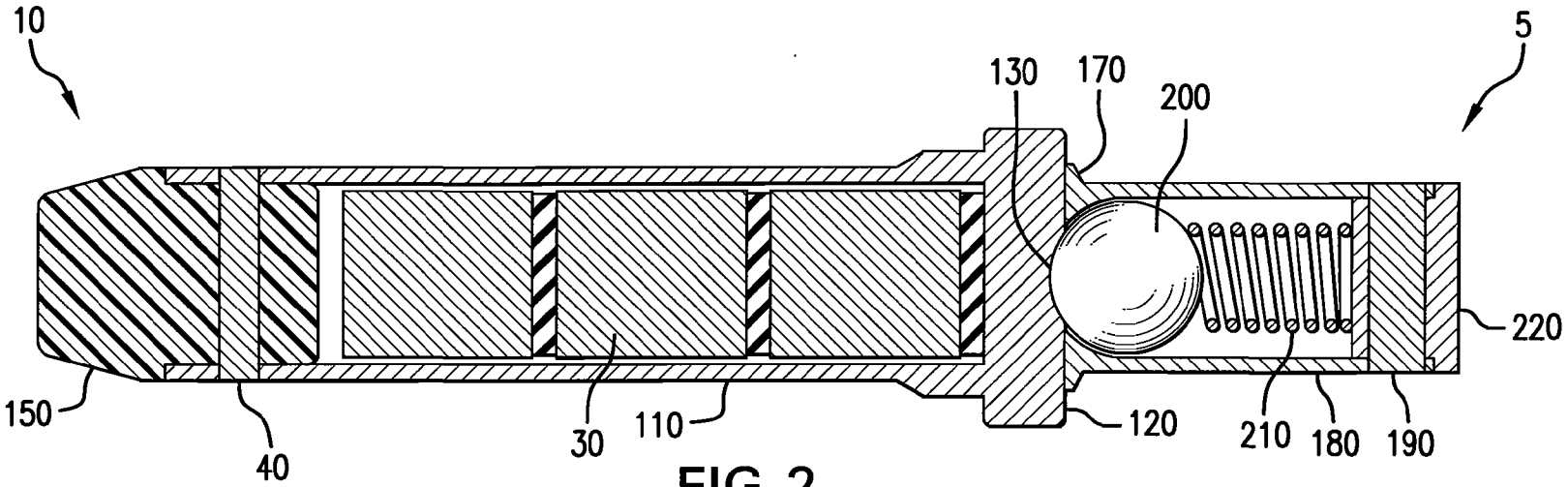
FIG. 2 is a cross-sectional view of the buffer assembly and carrier insert for embodying the present invention.
Figure 4:
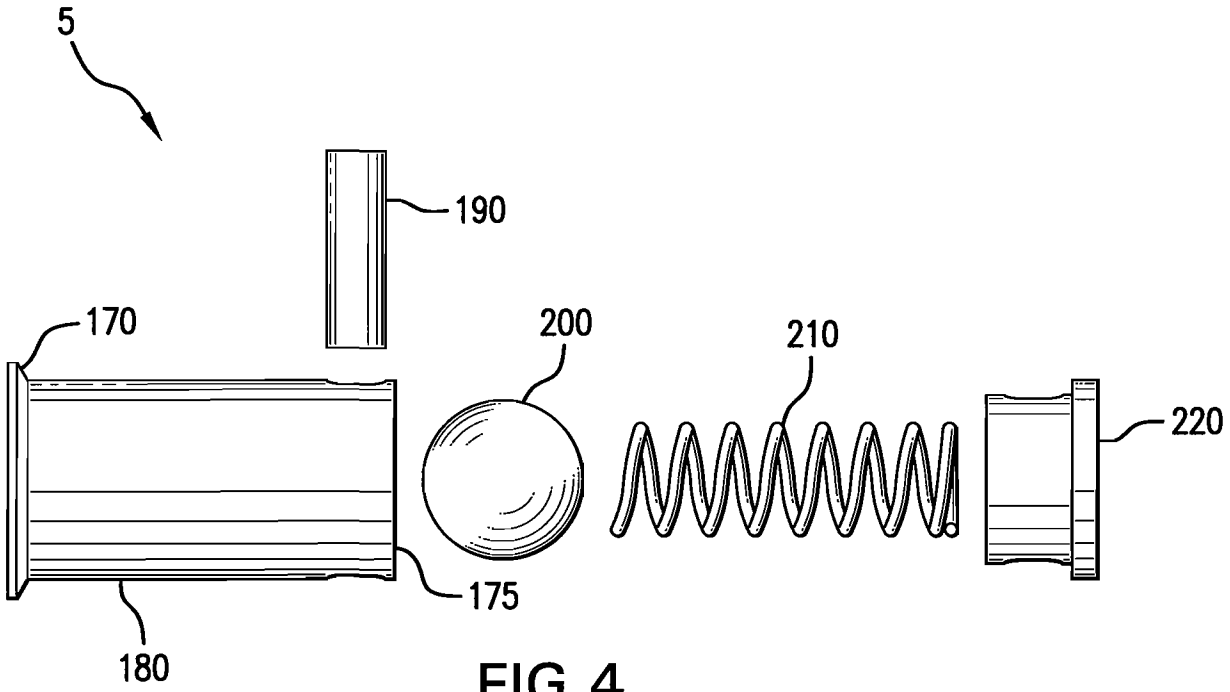
FIG. 4 is an exploded view of a carrier insert embodying the present invention.

FIG. 4 illustrates the novel carrier insert assembly 5 embodying the present invention. This carrier insert assembly, comprises a housing 180 open at one end, and partially closed by a collar 170 at its opposed end. The housing receives a ball bearing 200 which is urged toward the collar 170 by a spring 210. The spring is retained in tension by a carrier insert cap 220 closing the end of the housing remote from the collar. The carrier inset cap 220 is retained in position closing the carrier insert housing by means of an carrier insert pin which penetrates the walls of the housing and carrier insert cap. The carrier insert collar 170 has a central opening less than the diameter of the ball bearing 200 so that part of the ball bearing 200 enters the opening 175 and extends partially out of the opening (as shown in FIG. 2), but will not pass through the opening. The portion of the ball bearing extending from the opening corresponds to the alignment cavity 130 on the striking surface 120 of buffer assembly 10.

Figure 5:
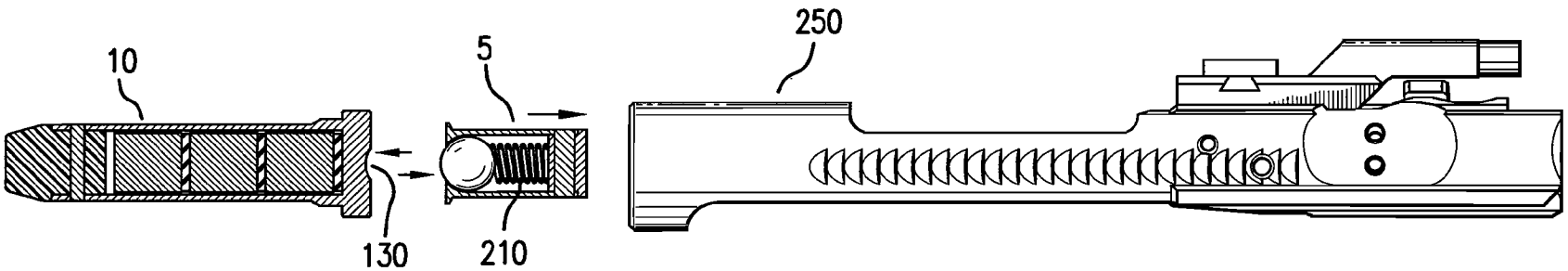
FIG. 5 is a schematic view of a buffer assembly, carrier insert and bolt carrier assembly for an AR15/M4 type firearm showing how the carrier insert would nest into the bolt carrier assembly and rest against a buffer assembly.

As illustrated in FIG. 2, when the buffer assembly 10 and the carrier insert are arranged together during firing and reciprocal action of the bolt carrier assembly 250, the novel carrier insert ball bearing 200 seats in the alignment cavity 130 on the striking surface 120 of the buffer assembly, thus centering and aligning the buffer assembly in the buffer tube 260, to provide the desired reciprocal action of the buffer recoil spring 270. FIG. 5 shows this longitudinal action of the bolt carrier assembly 250 which nests the carrier inset 5 in its open end, so that the buffer assembly 10 interacts with the carrier insert 5 in the directions of the arrows to provide smooth controlled operation of the firing and recoil operation of the weapon.

Figure 6:
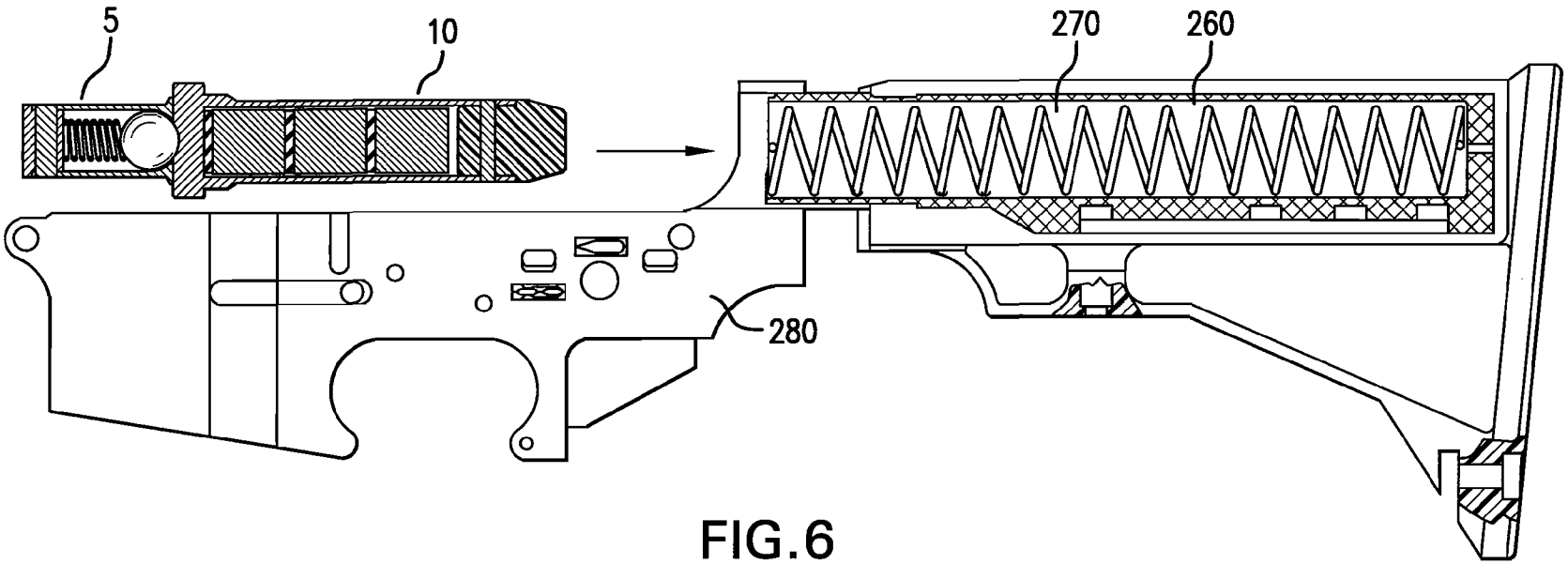
FIG. 6 is shows a partial section view of the carrier insert, buffer assembly, receiver lower and buffer tube with buffer recoil spring of a weapon embodying the present invention

The inter-relationship of the carrier insert 5, buffer assembly 10, buffer tube 260 and buffer recoil spring 270 arranged in the lower receiver 280 of the weapon is shown in FIG. 6, to provide smooth, controlled firing and recoil action of the weapon, thus reducing uneven wear and misfiring of the weapon.

In use, the carrier insert 5 and buffer assembly 10, as they strike one another during the firing of a weapon, the carrier insert 5 is positioned in the open end of the bolt carrier assembly 250. During firing, the bolt carrier assembly 250 moves rearward in to eject the casing of a bullet and to allow the next round to move into the firing chamber. The buffer assembly 10 is fitted into the buffer tube 260 abutting the buffer recoil spring 270. In a weapon having the disclosed invention, the carrier insert 5 and buffer assembly 10, and the bolt carrier assembly 250 would be aligned each time the rifle is fired as the ball bearing 200 in the collar 170 of the carrier insert 5 abuts the alignment concavity 130 and the striking surface 120 of the buffer assembly 10. The Bolt Carrier Assembly 250 is seated in the receiver upper 290. The receiver upper 290 and receiver lower 280 fit together to house the bolt carrier assembly 250 and carrier insert 5. The buffer assembly 10 is housed in the buffer recoil tube 260.

While the invention has been described and illustrated in substantial detail, many modifications and changes can be made without departing from the spirit and scope of the invention, Accordingly, it is not desired that the invention should be restricted to the exact construction disclosed.

The invention claimed is:

1. A buffer locking assembly for a rifle bolt carrier assembly in a weapon, said buffer locking assembly comprising
- a carrier insert,
- a buffer assembly,
- said buffer assembly adaptable to bear against said carrier insert when said bolt carrier assembly reciprocates against said buffer insert,
- said carrier insert and buffer assembly having releasably interlocking aligning means for holding said carrier insert and buffer assembly in a predetermined position when said bolt carrier assembly is reciprocated against said buffer assembly,
- said buffer assembly is free to rotate when seated in a buffer tube of said rifle.

2. The buffer locking assembly recited in claim 1, wherein said buffer assembly comprises a core inserted into a sheath, said core held in place with a cap with a terminus.

3. The buffer locking assembly recited in claim 2, wherein said sheath has a striking surface at one end adapted to strike said bolt carrier assembly when said weapon is fired.

4. The buffer locking assembly recited in claim 2, where said sheath has a striking surface adapted to receive said carrier insert aligning means when said carrier insert is arranged against said buffer locking assembly.

5. The buffer locking assembly recited in claim 4, wherein said sheath has a striking surface fabricated to receive said carrier insert aligning means.

6. The buffer locking assembly recited in claim 2, wherein said terminus and said sheath are apertured, and a pin is mounted in said aperture removably to secure said terminus to said sheath.

7. The buffer locking assembly recited in claim 1, wherein said rifle weapon is an AR15/M4 rifle.

8. The buffer locking assembly recited in claim 1, wherein said carrier insert is free to rotate within the said bolt carrier.

9. The buffer locking assembly recited in claim 1, wherein said carrier insert and said buffer assembly are free each to rotate independently while said bolt carrier reciprocates.

10. A buffer locking assembly for a rifle bolt carrier assembly in a weapon, said buffer locking assembly comprising
- a bolt carrier assembly with a carrier insert inserted in the aft end of said bolt carrier assembly,
- a buffer assembly,
  - said buffer assembly adaptable to bear against said carrier insert when said bolt carrier assembly reciprocates against said buffer assembly, and
  - releasably interlocking aligning means for holding said carrier insert and buffer assembly in a predetermined selected position under tension, said buffer assembly being able to rotate within a buffer tube, when said bolt carrier assembly is reciprocated against said buffer assembly.

11. A buffer locking assembly for a rifle bolt carrier assembly in a weapon, said buffer locking assembly comprising
- a carrier insert,
- a buffer assembly,
  - said buffer assembly adaptable to bear against said carrier insert when said bolt carrier assembly reciprocates against said buffer insert
  - said carrier insert and buffer assembly having aligning means for holding said carrier insert and buffer assembly in a predetermined position when said bolt carrier assembly is reciprocated against said buffer assembly;
- said carrier insert further comprising
- a hollow housing,
  - said housing being closed at one end and partially open at its other end;
  - a ball bearing having a dimension less than the diameter of said closed end, said ball bearing a portion of its surface extending out of said housing but Page 6 of 10 being restrained from exiting said closed end of said housing, and a spring in said housing having one end bearing against said ball bearing and another end bearing against said closed end.

12. A buffer locking assembly for a rifle bolt carrier assembly in a weapon, said buffer locking assembly comprising a carrier insert, a buffer assembly, said buffer assembly adaptable to bear against said carrier insert when said bolt carrier assembly reciprocates against said buffer insert said carrier insert and buffer assembly having aligning means for holding said carrier insert and buffer assembly in a predetermined position when said bolt carrier assembly is reciprocated against said buffer assembly;

said carrier insert further comprising a hollow housing, said housing being closed at one end and partially open at its other end;

a ball bearing having a dimension less than the diameter of said closed end, said ball bearing a portion of its surface extending out of said housing but being restrained from exiting said closed end of said housing, and a spring in said housing having one end bearing against said ball bearing and another end bearing against said closed end and wherein said housing is closed by a cap at its closed end.

13. A buffer locking assembly for a rifle bolt carrier assembly in a weapon, said buffer locking assembly comprising a carrier insert, a buffer assembly, said buffer assembly adaptable to bear against said carrier insert when said bolt carrier assembly reciprocates against said buffer insert said carrier insert and buffer assembly having aligning means for holding said carrier insert and buffer assembly in a predetermined position when said bolt carrier assembly is reciprocated against said buffer assembly;

said carrier insert further comprising a hollow housing, said housing being closed at one end and partially open at its other end;

a ball bearing having a dimension less than the diameter of said closed end, said ball bearing a portion of its surface extending out of said housing but being restrained from exiting said closed end of said housing, and a spring in said housing having one end bearing against said ball bearing and another end bearing against said closed end and wherein said housing is closed by a cap at its closed end and wherein said cap is removably secured against removal from said housing by a pin inserted in said housing.

14. The method for aligning a buffer assembly with a bolt carrier assembly in a rifle weapon while said bolt carrier reciprocates in a rifle weapon when fired, said method comprising the steps of providing a buffer assembly capable of rotating within a buffer tube and having a striking surface with an alignment cavity on one end of said buffer assembly providing a carrier insert with a spring-loaded bearing protruding from one end of said carrier insert, providing a bolt carrier, seating said carrier insert in the rear opening of said bolt carrier, longitudinally arranging said bolt carrier in line with said buffer assembly such that said bearing of said carrier insert and said alignment concavity of said buffer assembly are releasably interlocking, reciprocating said bolt carrier when firing said rifle weapon.

* * * * *